United States Patent [19]

Clarke, Jr. et al.

[11] 3,940,339

[45] Feb. 24, 1976

[54] LITHIUM BORATE COMPLEX GREASE EXHIBITING SALT WATER CORROSION RESISTANCE

[75] Inventors: George A. Clarke, Jr.; Gary L. Harting, both of Westfield, N.J.

[73] Assignee: Exxon Research & Engineering Co., Linden, N.J.

[22] Filed: Jan. 21, 1975

[21] Appl. No.: 542,800

[52] U.S. Cl. ..... 252/18; 252/25; 252/392

[51] Int. Cl.[2]. C10M 3/18; C10M 5/14; C10M 7/20; C10M 7/24

[58] Field of Search..... 252/18, 25, 392

[56] References Cited

UNITED STATES PATENTS 3,758,407 9/1973 Harting ..... 252/18

3,842,008 10/1974 Carman ..... 252/18

*Primary Examiner*—Delbert E. Gantz
*Assistant Examiner*—I. Vaughn
*Attorney, Agent, or Firm*—Byron O. Dimmick

[57] ABSTRACT

A lubricating grease having an exceptional ability to protect metal bearing surfaces against rusting or corrosion in the presence of salt water contains a synergistic combination of a lithium complex grease thickener, a quaternary ammonium nitrate and an amino imidazoline. The grease thickener is a complex of a lithium soap of a $C_{12}$ to $C_{24}$ hydroxy fatty acid and a monolithium salt of boric acid, and can include as a third component a lithium salt of a second hydroxycarboxylic acid such as salicyclic acid

7 Claims, No Drawings

LITHIUM BORATE COMPLEX GREASE EXHIBITING SALT WATER CORROSION RESISTANCE

BACKGROUND OF THE INVENTION

This invention concerns a lubricating grease composition that possesses an exceptional ability to protect metal bearing surfaces against rusting or corrosion in the presence of salt water. The grease composition contains a synergistic combination of a lithium complex grease thickener, a quaternary ammonium nitrite and an amino imidazoline.

There is an increasing need for a grease composition that will provide good protection against bearing damage caused by salt water corrosion. The grease of the present invention is one that furnishes both excellent corrosion resistance and outstanding high temperature characteristics.

REFERENCE TO PRIOR ART

In U.S. Pat. No. 3,730,896 of William P. Scott and Warren W. Woods, granted May 1, 1973, there is disclosed a grease composition having good low temperature properties as well as effective rust inhibiting properties. That composition comprises a major proportion of a synthetic hydrocarbon lubricant such as a monoalkylated benzene, a grease-forming amount of a lithium soap of a fatty acid and a rust inhibiting amount of a combination of lead naphthenate, a dicaprylate derivative of a fatty acid imidazoline alkyl diamine, and a dialkyl dimethyl quaternary ammonium nitrate or nitrite. It is disclosed in that patent that the rust inhibitor combination did not provide protection in salt water environments when used in a conventional petroleum oil grease thickened with a lithium soap. Lithium 12 hydroxy stearate is disclosed therein as a conventional lithium soap grease thickener.

DESCRIPTION OF THE PRESENT INVENTION

In accordance with the present invention, it has surprisingly been found that a grease that is prepared with a grease thickener comprising a complex of a lithium soap of a $C_{12}$ to $C_{24}$ hydroxy fatty acid and boric acid can be improved with respect to salt water corrosion protection by incorporating into the grease a corrosion inhibiting combination of a dialkyl dimethyl ammonium nitrite and an amino imidazoline.

The quaternary ammonium nitrite component of the corrosion inhibitor is a dialkyl dimethyl ammonium nitrite wherein the alkyl groups have from eight to 18 carbon atoms. Particularly preferred is a dialkyl dimethyl ammonium nitrite derived from coconut oil and containing about 55 to 70% of $C_{12}$–$C_{14}$ alkyl groups. One specific example of such a dialkyl dimethyl ammonium nitrite, which can be referred to as dicoco dimethyl ammonium nitrite, contains the following mixture of aliphatic groups.

Distribution of Aliphatic Groups

| | Percent |
|---|---|
| $C_8$ | 5 |
| $C_{10}$ | 6 |
| $C_{12}$ | 45 |
| $C_{14}$ | 20 |
| $C_{16}$ | 9 |
| Oleyl | 6 |
| Linoleyl | 8 |
| Linolenyl | 1 |

The other component of the corrosion inhibiting combination is an amino imidazoline of the following general structure:

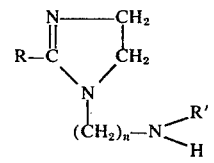

In the above formula, $n$ is about 2 to 6, preferably 2 to 3; R is a $C_6$ to $C_{22}$, preferably a $C_{12}$ to $C_{18}$, aliphatic hydrocarbon group, either saturated or unsaturated; and R′ is either hydrogen or a $C_1$ to $C_{12}$ alkyl group. Examples of R include hexyl, octyl, decyl, decenyl, 2-ethyl hexenyl, octadecyl, tetradecenyl, behenyl, and octadecenyl. Examples of R′ include methyl, butyl, octyl and dodecyl. Preferably R′ is hydrogen and n is 2 in the above formula.

A specific example of an imidazoline of the above formula, which was used in the working examples of the invention, was a commercial 1-(2-aminoethyl)-2-n-alkenyl-2-imidazoline having the formula:

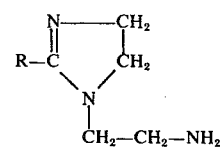

wherein R represents heptadecenyl and heptadecadienyl chains in a mol ratio of about 1:1, respectively. This imidazoline can also be referred to as mixed heptadecenyl-heptadecadienyl imidazoline ethylene diamine.

From about 1 to 4 weight % of the quaternary ammonium nitrite and from about 0.5 to 2 weight % of the amino imidazoline, based on the total grease composition, will be incorporated into the grease to impart the desired protection against salt water corrosion. Preferably from about 1.2 to about 2% by weight of the quaternary ammonium nitrite and from about 0.7 to about 1.3 weight % of the amino imidazoline will be incorporated into the grease.

The lithium complex greases that are improved by the present invention are those described in U.S. Pat. No. 3,758,407 of Gary L. Harting, granted Sept. 11, 1973.

The hydroxy fatty acid employed in preparing the greases of this invention will have from about 12 to 24, or more usually about 16 to 20 carbon atoms, and will preferably be a hydroxystearic acid, e.g., 9-hydroxy, 10-hydroxy, or 12-hydroxystearic acid, more preferably the latter. Ricinoleic acid, which is an unsaturated form of 12-hydroxystearic acid, having a double bond in the 9-10 position, can also be used. Other hydroxy fatty acids include 12-hydroxybehenic acid and 10-hydroxypalmitic acid.

When a second hydroxycarboxylic acid is used along with the boric acid and hydroxy fatty acid, it will be one having an OH group attached to a carbon atom that is not more than 6 carbon atoms removed from the carboxyl group. This acid has from 3 to 14 carbon atoms and can be either an aliphatic acid such as lactic acid, 6-hydroxydecanoic acid, 3-hydroxybutanoic acid, 1-hydroxycaproic acid, 4-hydroxybutanoic acid, 6-hydroxy-alpha-hydroxystearic acid, etc. or an aromatic acid such as parahydroxy-benzoic acid, salicyclic acid, 2-hydroxy-4-hexylbenzoic acid, metahydroxybenzoic acid, 2,5-dihydroxybenzoic acid (gentisic acid); 2,6-dihydroxybenzoic acid (gamma resorcyclic acid); 4-hydroxy-4-methoxybenzoic acid, etc. or a hydroxyaromatic aliphatic acid such as orthohydroxyphenyl, metahydroxyphenyl, or parahydroxyphenyl acetic acid. A cycloaliphatic hydroxy acid such as hydroxycyclopentyl carboxylic acid or hydroxynaphthenic acid could also be used. Particularly useful hydroxy acids are lactic acid, salicyclic acid, and parahydroxybenzoic acid.

Instead of using the free hydroxy acid of the latter type when preparing the grease, one can use a lower alcohol ester, e.g., the methyl, ethyl, or propyl, isopropyl, or sec-butyl ester of the acid, e.g., methyl salicylate, to give a better dispersion when the salt is insoluble. The amount of lithium salt of the hydroxy acid will range from about 0.1 to about 10 wt. % of the finished grease, or preferably from about 0.2 to about 5 wt. %. The monolithium salt or the dilithium salt of the second hydroxy acid can be used, but the dilithium salt is preferred.

The total soap and salt content of the grease will be in the range of from about 2 to 30 wt. % and preferably about 5 to 20 wt. %. The proportion of the $C_{12}$ to $C_{24}$ hydroxy fatty acid to boric acid will be in the range of a weight ratio of about 3 to 100 parts, or more usually about 5 to 80 parts, of hydroxy fatty acid per part by weight of boric acid. There will be a weight ratio of about 0.1 to 10, or more usually about 0.5 to about 5 parts of said second hydroxycarboxylic acid per part by weight of boric acid in the case of the greases made from three acid components.

The lubricating oil base that is used in preparing the grease compositions of this invention can be any of the conventionally used mineral oils, and will generally have a viscosity within the range of about 35 to 200 SUS at 210°F.

The greases can be prepared by coneutralizing all three types of acid, or alternatively by first neutralizing the boric acid and hydroxy fatty acid together and then forming the lithium salt of the second hydroxycarboxylic acid.

EXAMPLE

Employing the procedure described in Example 2 of U.S. Pat. No. 3,758,407, a grease was prepared using as the thickener system a combination of dilithium salicylate, lithium 12-hydroxy stearate and monolithium borate. Phenyl alpha naphthylamine was added to the grease as an antioxidant. To one portion of the grease, there was added as a rust inhibitor a combination of dicoco dimethyl ammonium nitrite and the mixed heptadecenyl-heptadecadienyl imidazoline ethylene diamine described above. A second portion of the grease contained only the dialkyl dimethyl ammonium nitrite and a third portion of the grease contained only the above-named imidazoline as the rust inhibitor component. An additional grease composition was prepared containing both the nitrite and the imidazoline but the grease thickener was simply the lithium soap of 12-hydroxy stearic acid.

All four of the grease compositions described above were subjected to a salt water corrosion test which was a modification of the procedure given in ASTM-D-1743. The test modifications included the substitution of either a 5% solution or a 10% solution in distilled water of the synthetic sea water described in ASTM Method D-665-IP 135 instead of the distilled water required by the original method. Another modification involved storing the wetted greased bearings for 24 hours at 125°F instead of the storage for 14 days at 77°F. as called for in the original method. However, the rating system used was the same as given in the ASTM procedure. The results obtained are shown in the following Table I which also sets out the composition of each grease that was tested. The repeated numbers are the results of replicate tests.

TABLE I

| Composition, g. | Grease 1 | 2 | 3 | 4 |
|---|---|---|---|---|
| 12 hydroxy stearic acid | 91 | 91 | 91 | 100 |
| lithium hydroxide, monohydrate | 41 | 41 | 41 | 15 |
| boric acid | 8 | 8 | 8 | — |
| methyl salicylate | 41 | 41 | 41 | — |
| Solvent 600 Neutral oil | 811 | 811 | 811 | 852 |
| phenyl naphthylamine | 8 | 8 | 8 | 8 |
| Dicoco dimethyl ammonium nitrite | 15 | 15 | — | 15 |
| Amino imidazoline* | 10 | — | 10 | 10 |
| Rust Ratings (ASTM D 1743) | | | | |
| 5% Synthetic Sea Water | 1,1,1,1, 1,1,1,1 | 3,3 | 3,3 | 1,1,1, 2,2 |
| 10% Synthetic Sea Water | 1,1,1, 2,2,2, 2 | — | 3,3 | 2,2,3, 3,3 |

*Mixed heptadecenyl-heptadecadienyl imidazoline diamine It will be seen from the above results that grease 1, which is a grease prepared in accordance with the present invention, gave clearly superior performance as compared to the other three greases. Grease 1 give eight excellent ratings in the 5% synthetic sea water test, a rating of 1 representing no corrosion, whereas significant rusting occurred in that test when either one or the other of the two components of the corrosion inhibitor combination of the invention was omitted (Greases 2 and 3). Grease 4 contained the corrosion inhibitor combination but was a simple lithium soap grease outside the scope of the present invention.

In addition to the rust or corrosion inhibitor combination of the invention, the grease compositions can also contain various other conventional grease additives, as is understood by those of skill in this art. Such additives include dyes, antioxidants, odor modifiers, tackiness agents, extreme pressure additives, and the like.

The scope of this invention is defined by the appended claims and is not to be limited to the specific embodiments presented in the examples.

What is claimed is:

1. A lubricating grease composition of high dropping point and capable of protecting metal surfaces against salt water corrosion which comprises a major proportion of a mineral lubricating oil, from about 2 to 30 wt. % of a thickener system whose essential components include a lithium soap of a $C_{12}$ to $C_{24}$ hydroxy fatty acid and a monolithium salt of boric acid, wherein there are from 3 to 100 parts by weight of hydroxy fatty acid per part by weight of boric acid, and a salt-water-corrosion resisting amount of a combination of a dialkyl dimethyl ammonium nitrite, wherein the alkyl groups have 8 to 18 carbon atoms, and an amino imidazoline of the general structure:

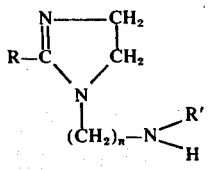

wherein n is about 2 to 6, R is a $C_6$ to $C_{22}$ aliphatic hydrocarbon group and R′ is hydrogen or a $C_1$ to $C_{12}$ alkyl group.

2. Composition as defined by claim 1 wherein in the general formula R′ is hydrogen and *n* is 2.

3. Composition as defined by claim 1 wherein the thickener system also includes as a third component a lithium salt of a second hydroxycarboxylic acid of from 3 to 14 carbon atoms, wherein the hydroxy group is attached to a carbon atom not more than 6 carbon atoms removed from the carboxyl group, and wherein there is a weight ratio of from about 0.1 to about 10 parts of said second hydroxycarboxylic acid per part of boric acid.

4. Grease composition as defined by claim 1 wherein said hydroxy fatty acid is 12-hydroxystearic acid.

5. Grease composition as defined by claim 3 wherein said second hydroxycarboxylic acid is salicyclic acid.

6. Grease composition as defined by claim 1 wherein said dialkyl dimethyl ammonium nitrite is a dialkyl dimethyl ammonium nitrite wherein the alkyl groups are principally $C_{12}$ and $C_{14}$ alkyl groups.

7. Grease composition as defined by claim 1 wherein the amino imidazoline is mixed heptadecenylheptadecadienyl imidazoline ethylene diamine.

* * * * *